US005481819A

United States Patent [19]

Teetzel

[11] Patent Number: 5,481,819

[45] Date of Patent: Jan. 9, 1996

[54] LASER MODULE APPARATUS

[76] Inventor: James W. Teetzel, 14 Stratham Green, Stratham, N.H. 03885

[21] Appl. No.: 200,204

[22] Filed: Feb. 23, 1994

Related U.S. Application Data

[63] Continuation-in-part of Ser. No. 89,889, Jul. 12, 1993, Pat. No. 5,425,299, which is a continuation-in-part of Ser. No. 73,766, Jun. 8, 1993, Pat. No. 5,355,608.

[51] Int. Cl.[6] ..... F41G 1/35; F41G 1/36

[52] U.S. Cl. ..... 42/103; 362/114

[58] Field of Search ..... 42/103; 362/110, 362/113, 114

[56] References Cited

U.S. PATENT DOCUMENTS

| | | | |
|---|---|---|---|
| 794,924 | 7/1905 | Cailliez | 362/114 |
| 894,306 | 7/1908 | Wright | 42/103 |
| 1,083,073 | 12/1913 | Ferguson et al. | 362/114 |
| 1,120,769 | 12/1914 | Villarejo | 362/114 |
| 1,215,171 | 2/1917 | Lewis | 42/103 |
| 1,263,667 | 4/1918 | Henderson et al. | 362/114 |
| 1,338,239 | 4/1920 | Matys | 362/114 |
| 1,615,409 | 1/1927 | Selden et al. | 362/114 |
| 1,950,835 | 3/1934 | Zajac | 362/114 |
| 2,085,732 | 7/1937 | Baxter et al. | 42/103 |
| 2,597,565 | 5/1952 | Chandler et al. | 362/110 |
| 3,914,873 | 10/1975 | Elliott, Jr. et al. | 42/103 |
| 4,102,059 | 7/1978 | Kimble et al. | 362/113 |
| 4,843,336 | 6/1989 | Kuo | 362/110 |
| 4,934,086 | 6/1990 | Houde-Walter | 42/103 |
| 5,179,235 | 1/1993 | Toole | 42/103 |
| 5,272,514 | 12/1993 | Dor | 42/103 |

FOREIGN PATENT DOCUMENTS

| | | | |
|---|---|---|---|
| 977351 | 3/1951 | France | 362/110 |
| 463383 | 4/1951 | Italy | 362/110 |
| 64732 | 4/1913 | Switzerland | 362/110 |

*Primary Examiner*—Stephen M. Johnson
*Attorney, Agent, or Firm*—William B. Ritchie

[57] ABSTRACT

A laser sight that can be fits conventional handguns and rifles without requiring major modification of the weapons and yet fits within the profile of the weapons framework. The invention features a chassis containing an infrared and visible red laser than can be mounted in various position, depending on the weapon selected. For a 9 mm handgun, the chassis mounts on the front face of the muzzle. For a M-16, the chassis mounts on the weapon handle. The weapons factory installed hand grips are replaced by modified hand grips that contain the laser electronic controls, water proof activation switches, and power source. The hand grips are wired to the chassis via a flexible internal circuit tape in the case of the 9 mm and waterproof quick disconnect cable for the M-16. The apparatus is designed to be used with commercially available batteries providing about 12 hours of operating time.

10 Claims, 10 Drawing Sheets

SECT. B-B

SECT. B-B

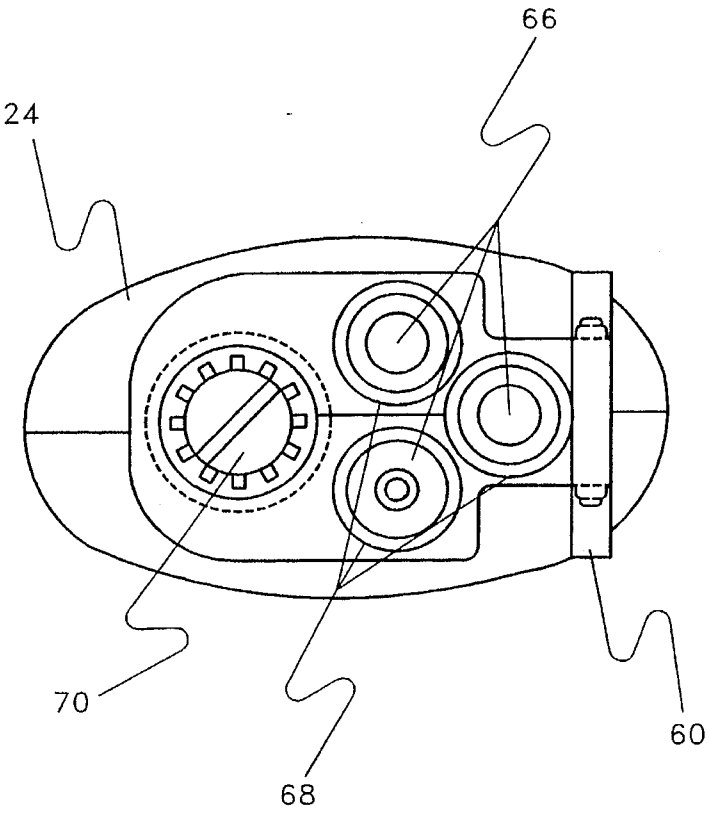
FIG. 6B
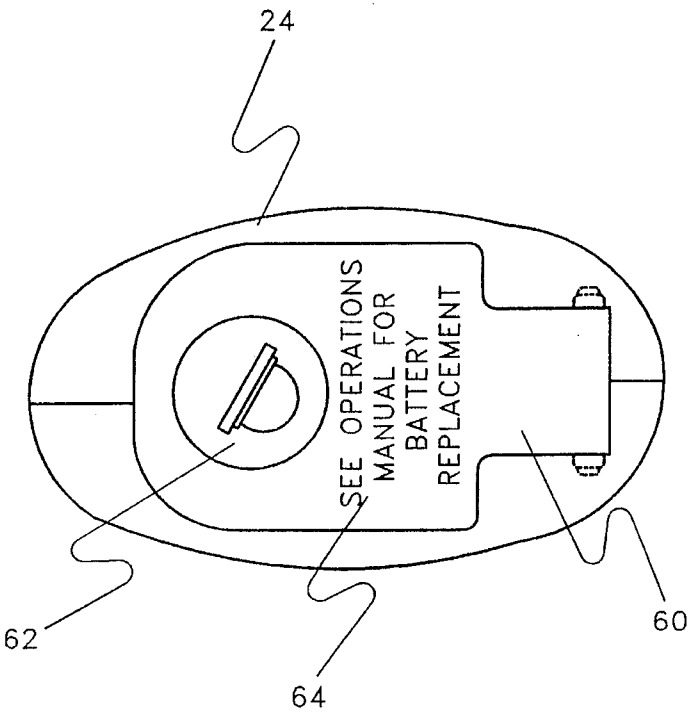

SECT. A-A

LASER MODULE APPARATUS

This application is a continuation-in-part of U.S. patent application Ser. No. 08/089,889, filed Jul. 12, 1993 now U.S. Pat. No. 5,425,299 which is a continuation-in-part of U.S. patent application Ser. No. 08/073,766, filed Jun. 8, 1993 now U.S. Pat. No. 5,355,608.

BACKGROUND OF THE INVENTION

1. Field of the Invention

The invention relates to laser sights and silencers for use on small firearms, particularly semi-automatic handguns and rifles.

2. Description of the Related Art

It is well known that even skilled marksman with a handgun have been unable to hit a target as close as 7 meters when attempting to draw the weapon and fire at speed. In target shooting, the shooter must obtaining the proper stance by carefully positioning the feet and the "free" hand to find the most stable condition, producing no muscular strain that will adversely effect the accuracy of the shot. Most importantly, the shooter must be able to obtain an identical position each time the weapon is fired to achieve the greatest accuracy. As the whole upper torso moves during each breath, breath control plays a vital role in the process. Since there can be no body movement at the time the trigger is fired, obviously the act of breathing must be stopped during the time the weapon is aimed and fired.

Sight picture and aim are critical if the shooter is to fire the most accurate shot or series of shots. When a mechanical pistol sight is properly aligned, the top of the front sight should be level with the top of the rear sight, with an equal amount of light on either side of the front sight. Using this sight picture requires that the shooter focus his shooting eye so that the sights are in focus and the target is out of focus. Added to the difficulty, the trigger, all of the above must be maintained while the trigger is released using direct, even pressure to keep the barrel of the gun pointing at the target. These skills require tremendous practice, with each shot fired needing the utmost concentration if the shooter is to obtain maximum accuracy.

It is clear that the recommended methods of achieving maximum shooting accuracy useful for target shooting, must be severely modified when a handgun is used in a law enforcement situation. While the degree of accuracy necessary for target shooting and the distances and substantial lower, accuracy is still vital. Law enforcement official are instructed to fire only as a last resort, cognizant of the fact that their intended target will mostly be killed. Shooting to wound occurs only in the movies. Law enforcement officers typically use higher caliber handguns, mostly 9 mm, which are designed to immobilize with a single shot if that shot strikes a vital area. Given the inherent inaccuracies in the shooting process itself, exacerbated by the stress and fear of the police officer in what may be a life threatening situation for him/her, the exact location of the bullet where millimeters can mean the difference between death and survival cannot be known a priori by the even the most skilled marksman.

Mechanical sights have limited value in many situation where an officer must quickly draw his gun, perhaps while moving, and fire at a close target without sufficient time to properly obtain a sight picture. Under these circumstances, instinctive aiming, that is, not using the sights but rather "feeling where the gun barrel is pointing using the positioning of the hand holding the gun, is the preferred method. While this method, akin to the typical television cowboy shootouts, can be reasonably effective at short distances, obviously large errors in aiming are easily introduced, especially when the officer must frequently fire his/her weapon from a different hand position that has been used for practice. For example, bullet proof shields are used to protect the officer from being fired upon such as in a riot situation. In those circumstance, the officer must reach around his/her shield or other barricade and instinctively aim and fire his/her gun with the handgun in a very different orientation that would be experience if fired from a standing, drawn from a holster position. Small changes in barrel orientation due to the sight radius of the typical law enforcement handgun can produce substantial errors relative to the target. Accurate instinctive shooting is not considered practical beyond 20 feet for the average shooter.

The same problems face a soldier in a combat situation. While a rifle is inherently more accurate that a handgun, the stress of combat, the need to fire rapidly but accurately in order to survive is sufficient to introduce substantial errors into the sighting process. These problems are further exacerbated by the fact that most military personnel do not have sufficient practice time with their weapon to develop a high proficiency, particular in combat simulated situations.

A solution to this problem for handguns has been the introduction of laser sights. The typical laser sight is mounted on the top on the handgun or on the bottom. The laser sight when properly aligned, places a red light dot on the target where the bullet will strike if the gun is fired. Using this type of sight, enables the law officer to rapidly instinctively properly position the weapon and be certain of his/her intended target. Using a laser sight enables accurate shots to be fired at distances of more than 50 feet, sufficient for most combat law enforcement situations requiring the use of handguns.

U.S. Pat. No. 4,934,086, issued to Houde-Walter on Jun. 19, 1990, discloses installing the laser sight within the recoil spring guide. The use of the recoil spring guide to house the laser sight components enables the firearm to be holstered in a normal manner. The use of the spring recoil guide presents alignment problems to ensure accuracy. In other words, the laser within the recoil guide is difficult to align with the barrel of the firearm. Therefore, misalignment of the sight resulting in poor accuracy is likely.

However, prior art laser devices have several disadvantages. As they are mounted either on the top or the bottom of the weapon, the balance of the gun is disturbed which makes it more difficult for the shooter to rapidly use his/her instinctive sighting technique to move gun into alignment for hitting the desired target. Also, since prior art laser sights are very bulky in comparison to traditional mechanical sights, the weapon cannot be used in a standard holster. Further, the laser sight is extremely vulnerable to being hit due to extending substantially beyond the normal profile of the weapon and thereby misalignment of the sight and defeating the advantages offered by the laser sight. A laser sight capable of being installed in a semi-automatic handgun, easily and accurately adjustable, is not disclosed in the prior art.

A laser sight for a standard military issue weapon such as the M-16 that can be attached to the weapon without requiring a major modification of the firearm is not available. Use of the type of laser sights discussed below for handguns will also exhibit the same type of problems relative to installation on an M-16.

Prior art laser devices have several disadvantages. As they are mounted either on the top or the bottom of the weapon, the balance of the gun is disturbed which makes it more difficult for the shooter to rapidly use his/her instinctive sighting technique to move gun into alignment for hitting the desired target. The particular design of the M-16, having a carrying handle on the top of the firearm, makes adding a prior art laser devices to this weapon impractical. Also, since prior art laser sights are very bulky in comparison to traditional mechanical sights, when used with a handgun, the weapon cannot be used in a standard holster. Further, the laser sight is extremely vulnerable to being hit due to extending substantially beyond the normal profile of the weapon and thereby misalignment of the sight and defeating the advantages offered by the laser sight. A laser sight capable of being installed in a semi-automatic handgun or on a military rifle such as an M-16, easily and accurately adjustable, is not disclosed in the prior art.

SUMMARY OF THE INVENTION

It is an object of the invention to provide a laser module sight apparatus that can be completely concealed within the standard framework of the weapon.

It is another object of the invention to provide a laser module sight apparatus that can be retro-fitted to standard semi-automatic handguns or to standard military rifles such as an M-16.

It is still another object of the invention to provide a laser module sight apparatus that enables the pistol version to be used with standard holsters designed for that particular weapon.

It is still another object of the invention to provide a laser module sight apparatus that can be fitted to various semi-automatic handguns and military rifles requiring a minimum replacement of standard parts.

It is another object of the invention to provide a laser module sight apparatus that can easily adjusted by the user to permit accurately alignment of the laser sight with the barrel of the gun.

It is another object of the invention to provide a laser module sight apparatus that can be inexpensively produced using primarily commercially available parts.

It is another object of the invention to provide a laser module sight apparatus that can incorporate an infrared diode that makes the dot invisible to the naked eye, but clearly visible using standard night vision equipment.

It is still another object of the invention to provide a laser module sight that can easily substitute a flashlight bulb in place of the laser diode.

It is another object of the invention to provide a laser module sight apparatus that is extremely light compared to existing lasers and their mounts.

It is still another object of the invention to provide a laser module sight apparatus that can be controlled from the handgrip of the firearm.

It is another object of the invention to provide a laser module sight apparatus that can be powered by commercially available batteries, providing at least several hours of service time before needing to be changed.

It is another object of the invention to provide a laser module sight apparatus that will incorporate a delay when the frame mounted switch is deactivated before the laser is turned off, thus permitting time for the user to activate the trigger switch without losing sight on the target.

It is another object of the invention to provide a laser module sight apparatus that will provide an adjustable pulse rate so that "friendly" laser beams can be distinguished from a laser beam from an enemy.

It is another object of the invention to provide a laser module sight apparatus that eliminates the need for a pressure pad on the grip handle which is awkward when holding the gun and requires adjustments to the shooter's grip to keep the laser off while maintaining stability.

The invention is a laser sight for a firearm, said firearm having standard issue hand grips. The invention has a chassis, mountable within the profile of the framework of the weapon, with the chassis having a front face, with said chassis having at least one light source housed within said chassis. The invention has laser control system mounted within modified handgrips having an exterior and interior surface that mount on said weapon replacing the standard issue hand grips. Said hand grips further comprising a plurality of rubberized switches located on the exterior surface of said modified handgrips, said switches controlling the light in said chassis. Said hand grips further comprising flexible circuit means adjacent to and corresponding in size to the interior surface of said handguns. Battery means is provided within the framework of said weapon to which said handgrips are attached for providing to said flexible circuit means. Finally, connection means for connecting said flexible circuit means to said light within said chassis is provided.

BRIEF DESCRIPTION OF THE DRAWINGS

FIG. 6B is a bottom view of the modified hand grips in place on the M16 showing the battery door in a closed and opened position.

DETAILED DESCRIPTION OF THE INVENTION

Figure 1:
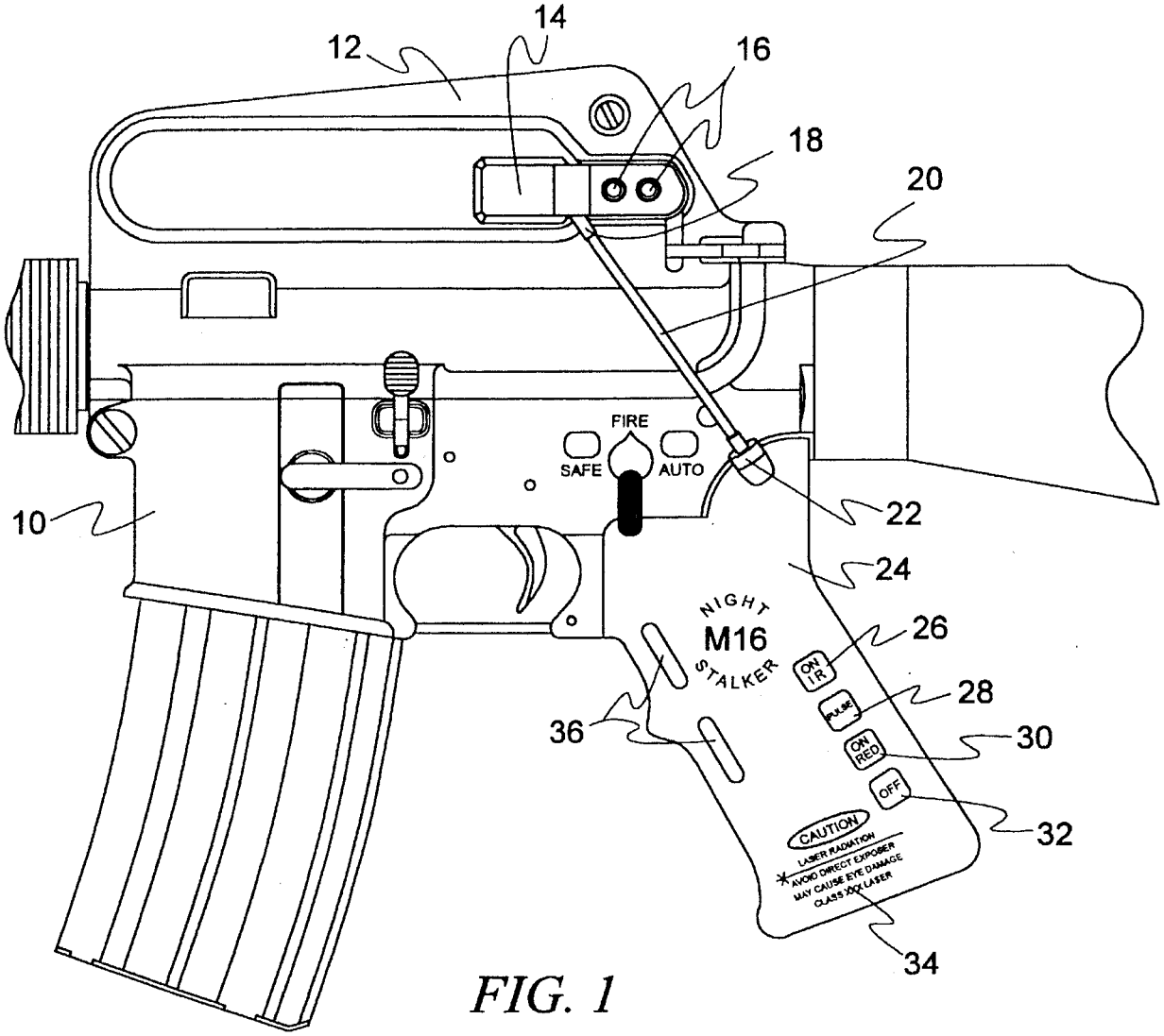
FIG. 1 is a partial side view of an M16 with laser module apparatus attached in accordance with the invention.

FIG. 1 is a partial side view of M16 10 with laser module apparatus attached. The apparatus comprises three major components: hand grip assembly which houses the circuitry, batteries and controls for the apparatus; laser chassis; and the connection harness which electrically connects the chassis with the hand grips. Hand grips 24 replace the standard hand grips that are issued with weapon 10. Hand grips 24 correspond closely in size and shape to the original equipment grips. As shown, the apparatus can be easily controlled by the operator by pushing the rubber switch buttons on grip 24. Rubber switch buttons 26, 28, 30, 32, 36 are waterproof so that the circuitry is protected during use in adverse weather conditions. Button 26 selects the infrared laser. Button 28 selects the laser pulse rate. The pulse rate is adjustable so that the operator can set their weapons to a different pulse rate than that of an enemy. In this manner, it is an easy matter to determine friend from foe. Button 30 selects a visible red laser. Button 32 turns the system on or off. Button 36 activates the chosen laser, that is, either visible or infrared when pressed. Indicia 34 instructs the operator as to proper procedure to follow to avoid eye injury. Chassis 14, which houses the laser diode assembly is attached to handle 12 of weapon 10 within the recess of the handle. Thus, the apparatus can be connected to weapon 10 without the need for modifying weapon 10, yet, fit within the existing profile of the firearm so that it will not interfere with carrying, storing or firing the weapon.

Chassis 14 is held onto handle 12 by merely tightening set screws 16.

Cable 20 electrically connects chassis 14 to hand grips 24. Cable 20 is preferably waterproof. Cable 20 connects to chassis 14 through rubber boot 18. Cable 20 connects to hand grips 24 via a male waterproof quick disconnect 22.

Figure 2:
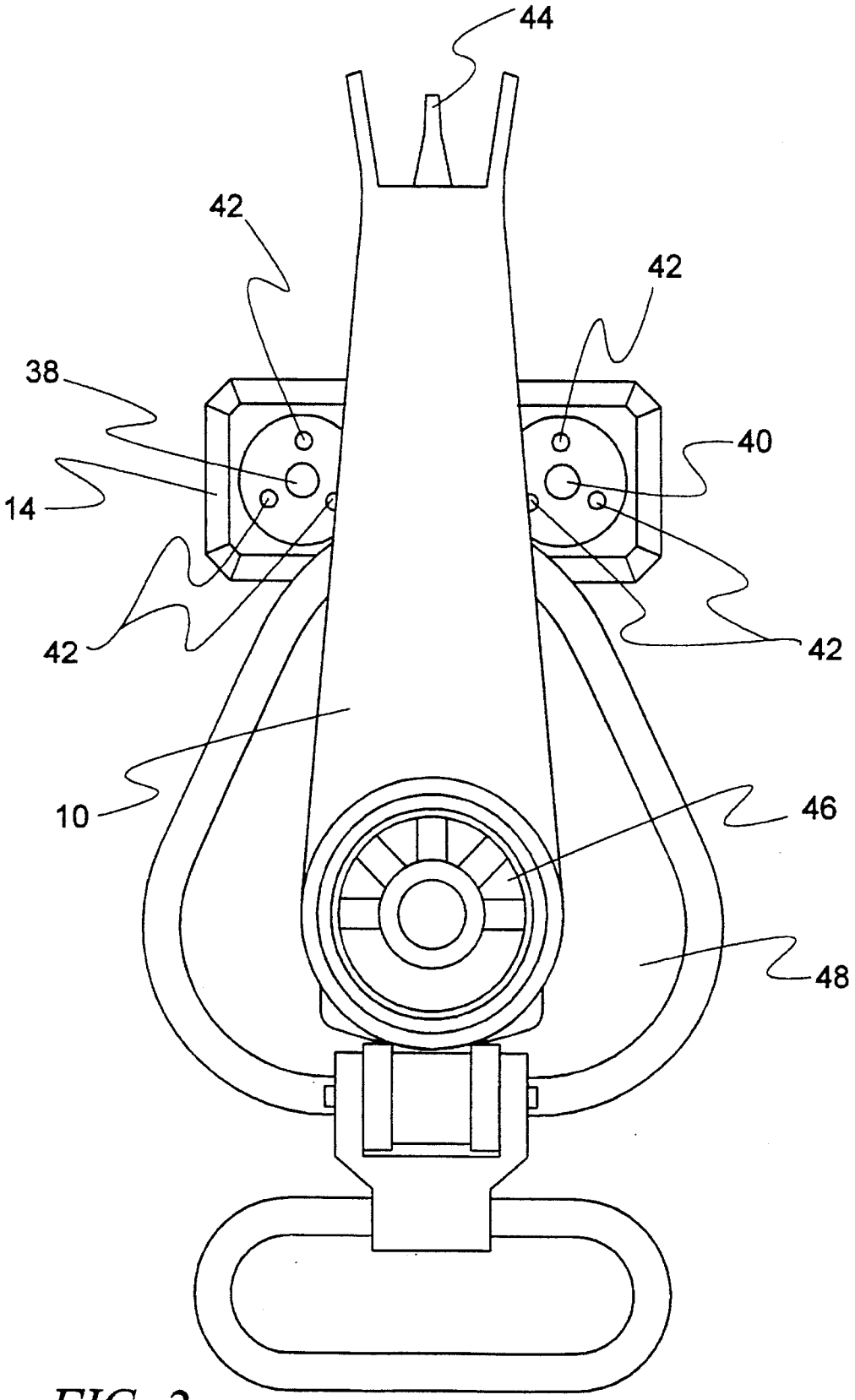
FIG. 2 is a front view of the M16 showing the chassis of the laser module attached to the handle of the M16.

FIG. 2 is a front view of weapon 10 showing chassis 14 of the laser module apparatus attached to handle 12 as seen looking down the muzzle 46 of the weapon. Note that chassis 14 with laser 38 and 40 are within the profile of forestock 48 and do not interfere with mechanical sights 44. Thus, as noted above, minimal changes required to mount the apparatus to the weapon 10. Laser 38 is infrared and laser 40 is visible red. Each laser can be independently adjust for elevation and windage using adjustment set screws 42.

Figure 3:
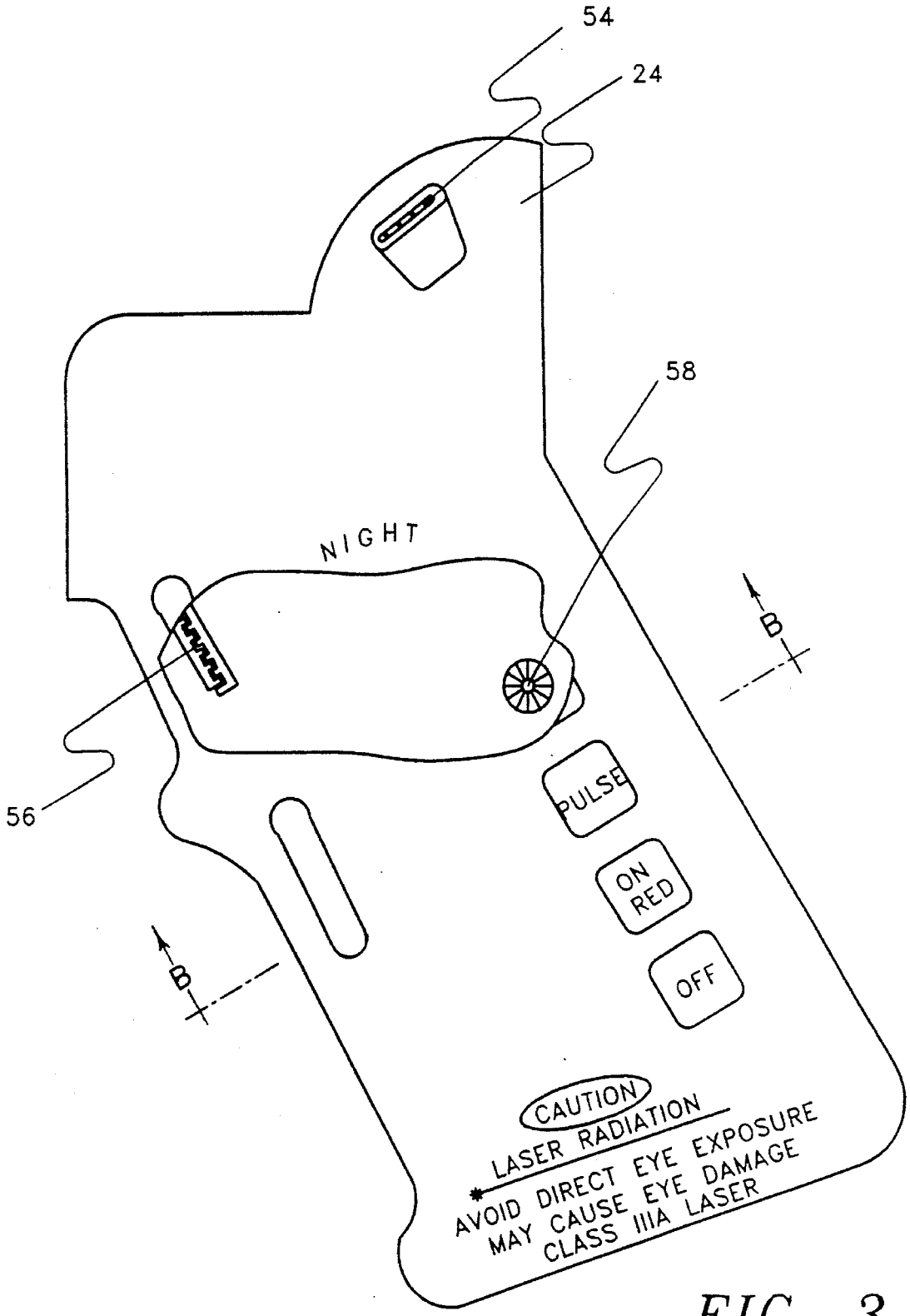
FIG. 3 is a side view of the modified left hand grip assembly.

FIG. 3 is a side view of modified left hand grip 24 showing a cut-a-way view of the button contact 56 and 58 on the flexible circuit 50. Female quick disconnect 54 connects to cable 20 (shown in FIG. 1).

Figure 4:
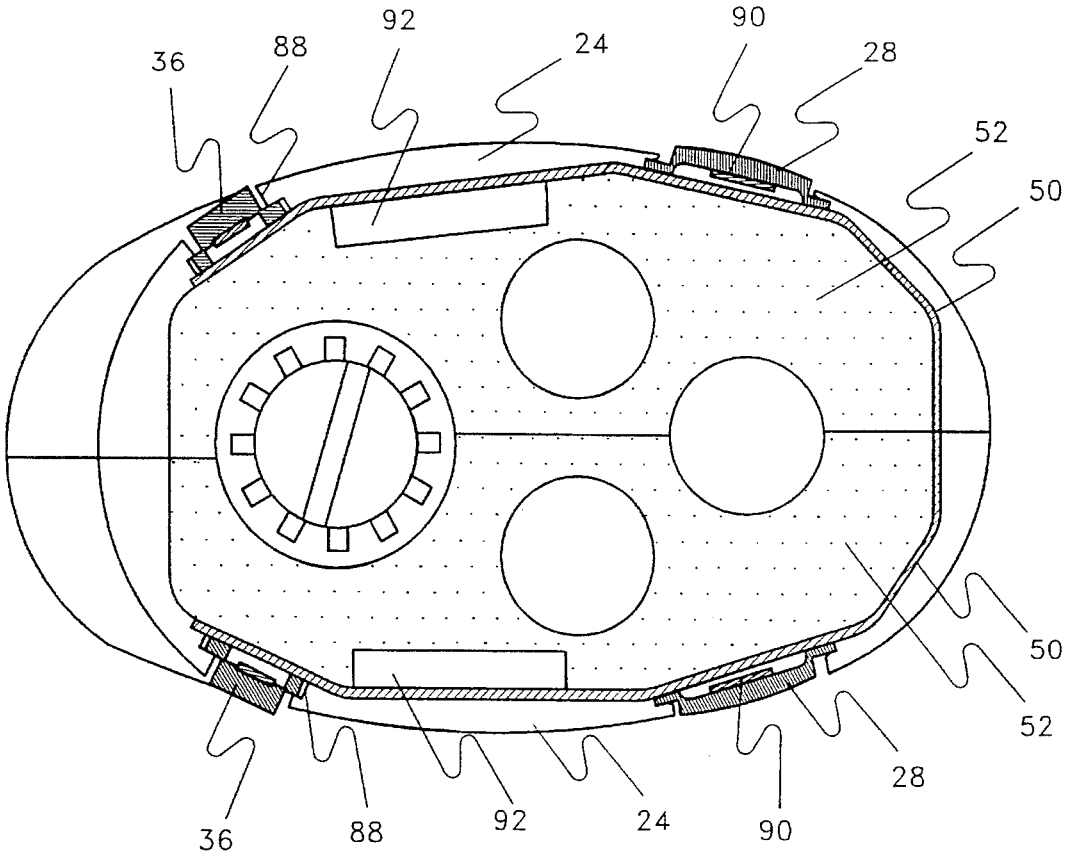
FIG. 4 is a cross-sectional view of the handgrips attached to the M-16 across B—B of FIG. 3.

FIG. 4 is a cross-sectional view of the handgrips attached to the M-16 across B—B of FIG. 3. Flexible circuit 50 is shown fitted within the interior wall of left hand grip 24. The flexible circuit 50' is shown fitted with interior wall of right hand grip 24'. Rubber button 28, for example, when pushed causes conductive rubber puck 90 to make an electrical connection with a contact (such as 56 and 58, shown in FIGS. 3 and 5) thus to select the corresponding function in the apparatus. Recesses 92 and 92' house electronic components that are soldered to the flexible circuits. Stiffeners 52 and 52' hold the flexible circuits in place within the hand grips 24 and 24', respectively.

Figure 5:
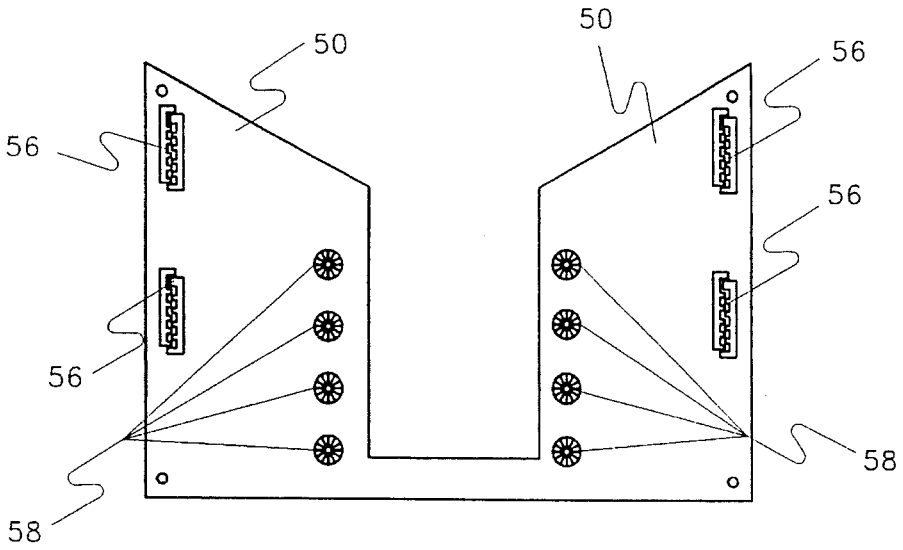
FIG. 5 is a top view of the flexible circuit that fits within the modified hand grips assembly.

FIG. 5 is a top view of the flexible circuit that fits within the modified hand grips assembly. Contacts 58 are the buttons on the left side hand grips 24 and contacts 58' are for the buttons on the right side hand grips 24'. Flex circuit is sized in accordance with grips 24 and 24'. When fitted to other sized firearms, the size of the flexible circuits are adjusted accordingly. However, the functional circuitry would remain the same.

Figure 6A:
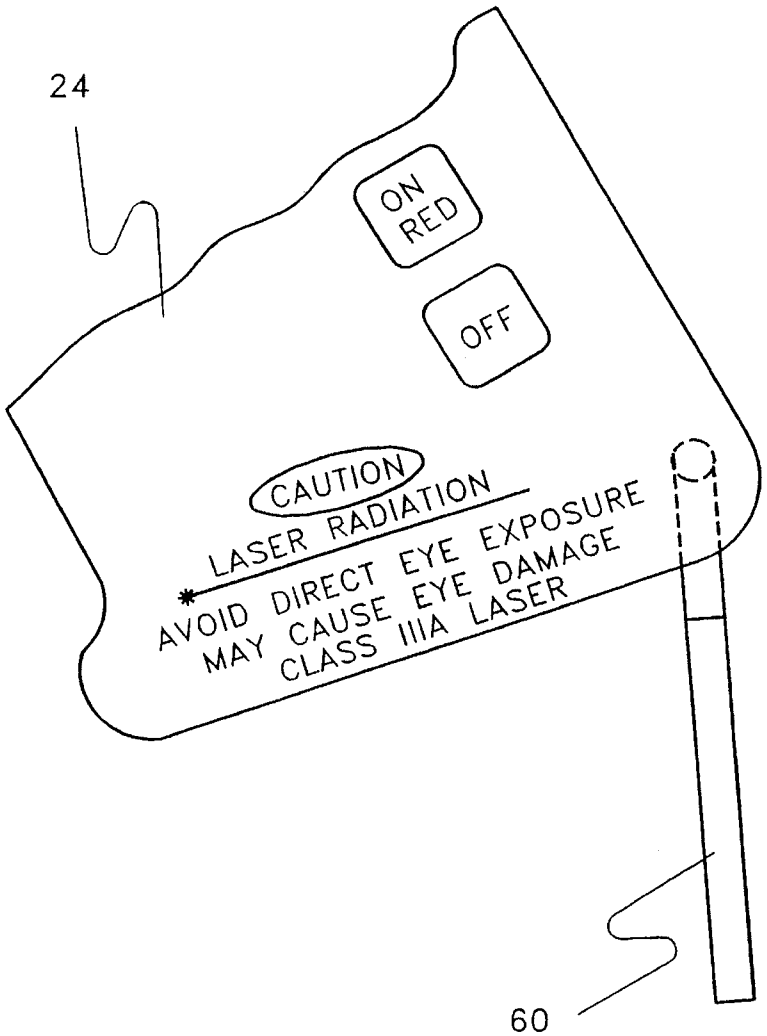
FIG. 6A is a partial side of the left modified hand grip showing the battery door in a closed and opened position.
Figure 6A:
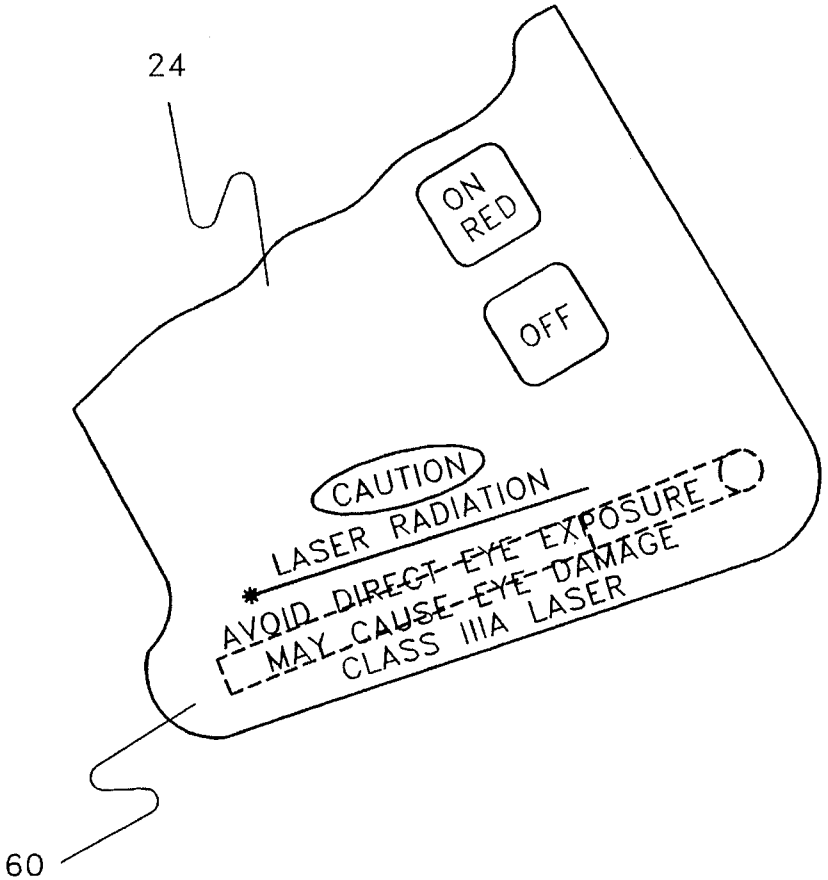

FIG. 6A is a partial side of the left modified hand grip 24 showing the battery door 60 in a closed and opened position. FIG. 6B is a bottom view of the modified hand grip 24 in place on the M16 10 showing the battery door 60 in a closed and opened position. Battery door 60 is opened by inserting a bullet casing into locking screw 62. Once opened, screw and washer assembly 70 is shown. Assembly 70 is used to mount the hand grips to weapon 10. Three commercial batteries 66, AAA size, are used to power the unit. O-ring seals 68 seal the batteries against moisture that might leak through door 60 that could damage the unit.

Figure 7A:
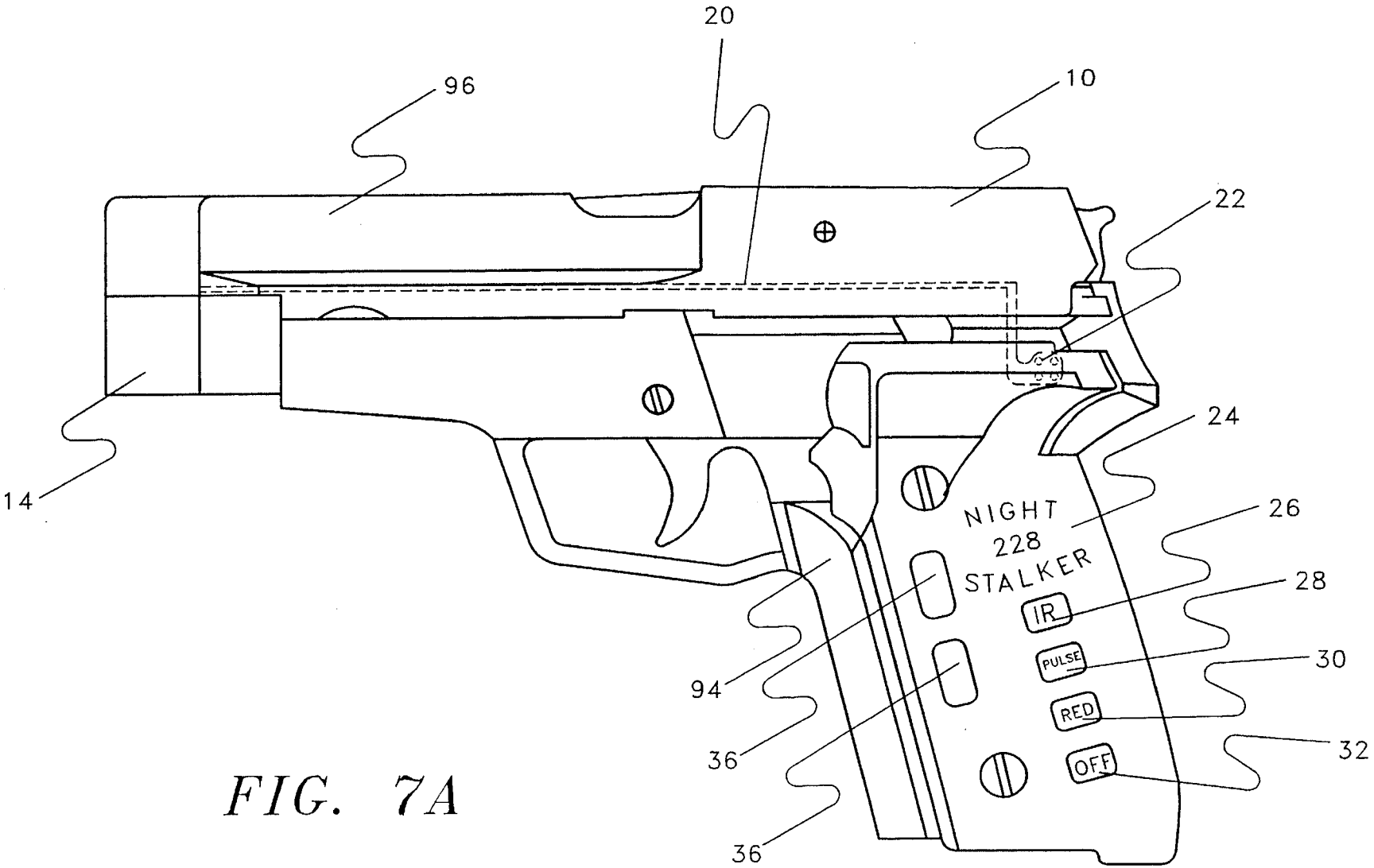
FIG. 7 is side view of the laser module apparatus attached to a typical semi-automatic handgun in accordance with the invention.

FIG. 7A is side view of the laser module apparatus attached to a typical semi-automatic handgun 10. In this case, weapon 10 is SIG-SAUER Model P228, 9 mm, with a 13 cartridge clip or magazine. This particular pistol has been adopted by numerous military and law enforcement agencies as the weapon of choice because of its large magazine capacity, reliability, and accuracy. In operation, the slide 96, guided by a recoil spring guide and tensioned by recoil a spring, is slid backwards along frame, tensioning the recoil spring. The barrel and the recoil spring guide extend through barrel hole and recoil spring guide hole respectively. Therefore, Once slide 96 is released, the spring causes slide 96 to move forward, strip a round from the magazine, and place the cartridge into the firing chamber. When slide 96 is in its most forward position on frame, the recoil spring guide and the barrel are substantially flush with front face of slide 96.

In this embodiment, chassis 14 is mounted on the muzzle of the weapon 10. Chassis 14 is the same here with the respect the laser diode 38 and 40, only the external shape of chassis 14 is changed to match that of the weapon that chassis 14 is installed on. Again, chassis 14 can be attached with minimum changes to the weapon as it comes from the factory. Hand grips 24 are modified to replace the original equipment hand grips (not shown) that are shipped with weapon 10. Again, as with the M-16, hand grips 24 are sized in accordance with the factory original grips. Therefore, frame section 94 of the weapon 10 is not covered as is the case using the factory grips.

Figure 7B:
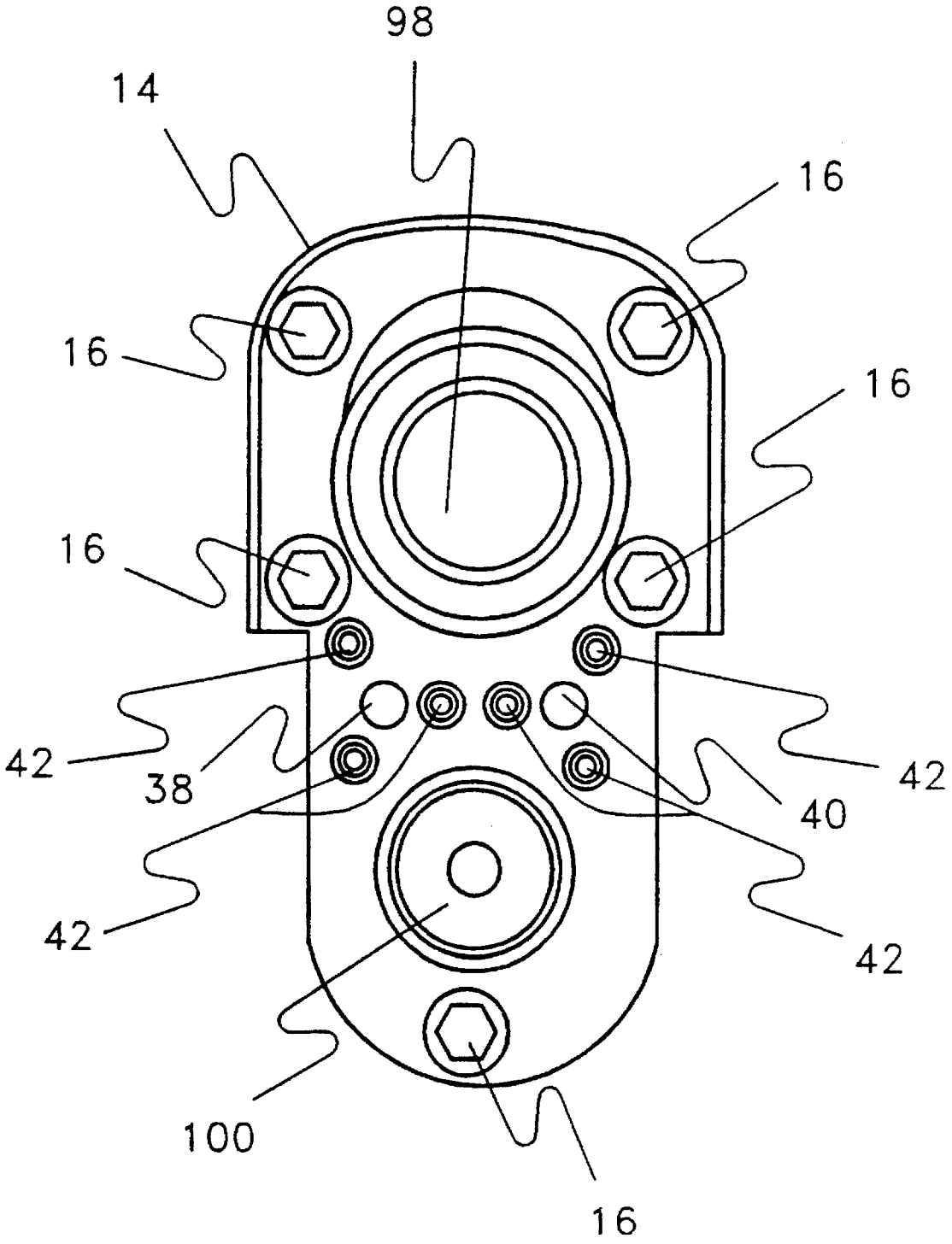

As shown in FIG. 7B, the placement of lasers assembly 38 and 40 are similar. Only in this embodiment, it is necessary to provide barrel hole 98 and recoil slide hole 100. Hole 98 allows the fired bullet to exit through chassis and hole 100 allows the recoil slide to extend therethrough when slide 96 is furthest back.

Figure 8:
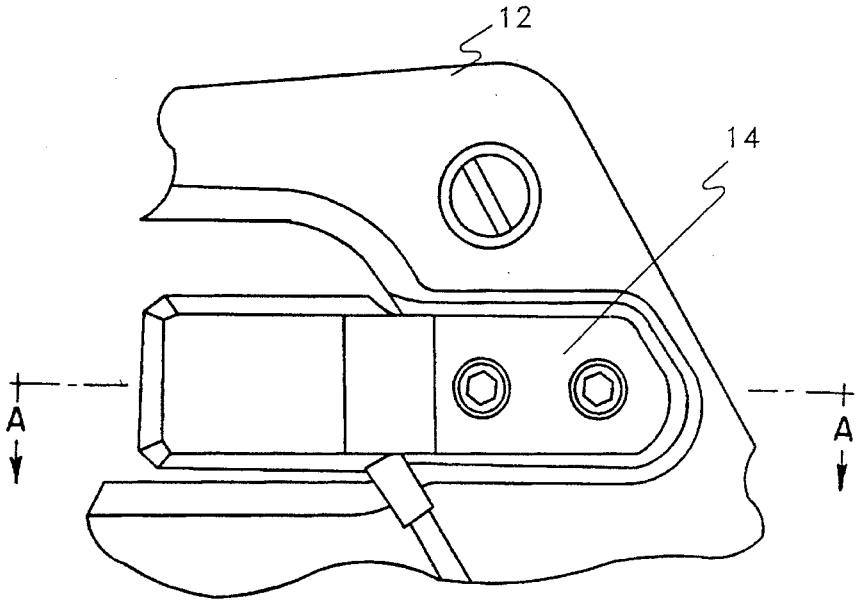
FIG. 8 is a detailed side view of the chassis attached to the handle of the M16.
Figure 9:
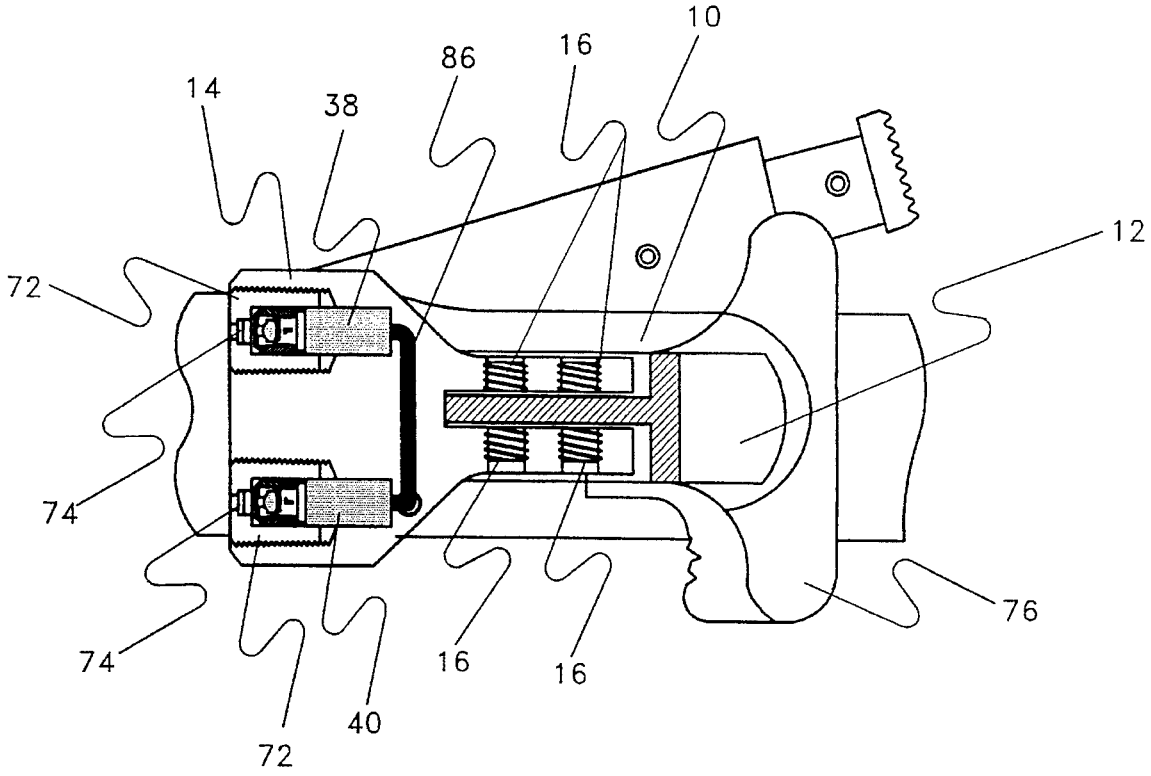
FIG. 9 is a cross-sectional view of the chassis across A—A in FIG. 8.

Referring now to FIGS. 8 and 9 is a detailed cross-sectional top view of the chassis 14 attached to the handle 12 of the weapon 10. Set screws 16 are tightened which lock chassis 14 to the recess within handle 12. Lasers 38 and 40 are housed within chassis 14. Lens material 74 is sealed into threaded bezel, thus making the connection waterproof, and serves to focus the lasers. Plastics threaded bezel 72 secures the laser assembly 38 and 40 into chassis 14. Threaded bezel 72 contains windage and elevation adjustment set screws (shown in FIG. 2) Weapon charging handle assembly 76 is used to load a round into the weapon. Cable 86 connects the lasers to cable 20.

Figure 10:
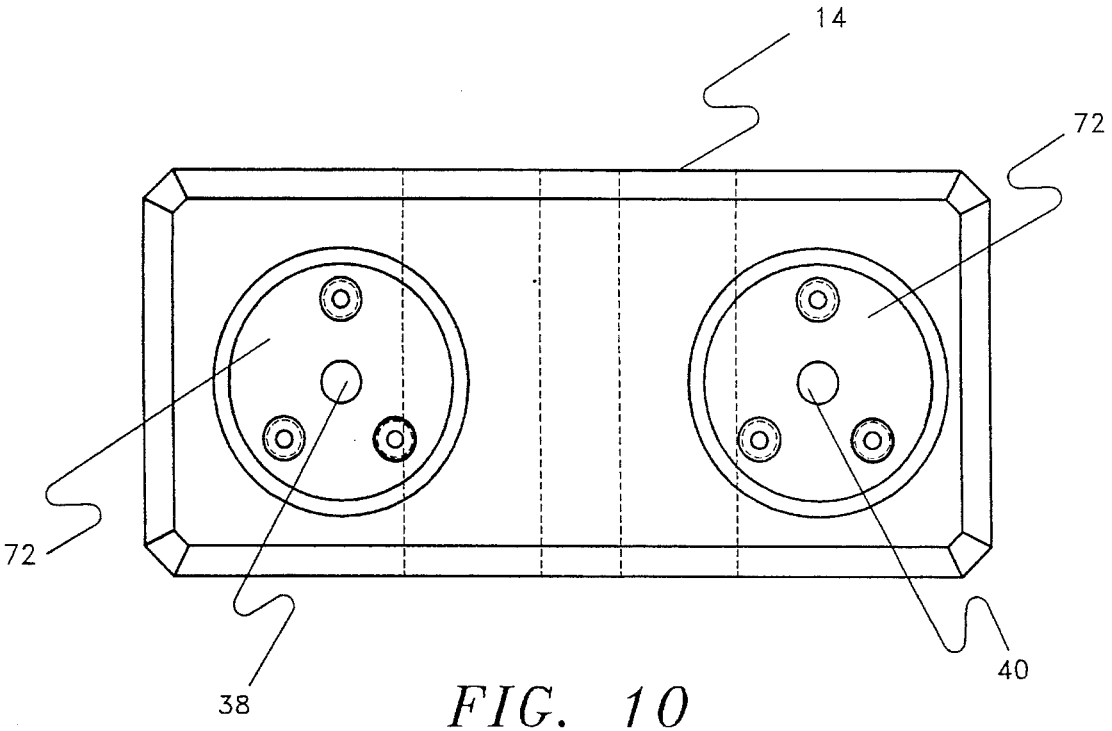
FIG. 10 is a front view of the chassis.

FIG. 10 is a front view of the chassis 14 which shows adjustment set screws 42 set within bezel 72 to permit adjusting the windage and elevation of the sight apparatus.

Figure 11:
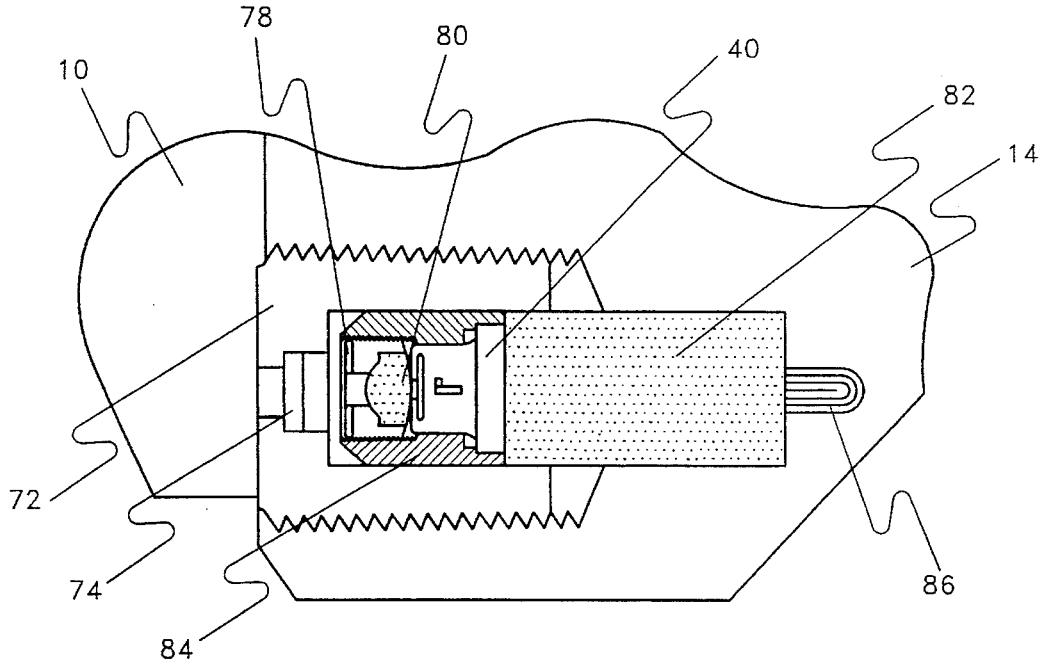
FIG. 11 is a detailed cut-a-away view of a laser diode assembly.

FIG. 11 is a detailed cut-a-away view of a laser diode assembly 40. The laser driver 82 is potted in epoxy resin or the equivalent to make certain the assembly is water proof. Aspheric collimating lens 80 focuses the beam from the diode. Housing 84, preferably aluminum, serves as heat sink to laser diode from overheating.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A laser sight for a rifle, said rifle having hand grips attachment members and a handle with an opening, said laser sight comprising:

a chassis mountable on said rifle substantially within the opening of said handle of said rifle, said chassis having a front face with at least one laser device housed within said chassis, with the light form said laser device exiting the front face of said chassis;

hand grips having interior and exterior surfaces, dimensioned and sized to be attached to hand grips attachment members of said rifle, said hand grips having a plurality of waterproof rubber switches mounted on the exterior surfaces of said grips, said switches selecting said laser device;

connection means for electronically connecting said hand grips and said chassis.

2. The laser sight of claim 1 further comprising flexible circuit means, adjacent to and corresponding in size to the interior surfaces of said hand grips, for electronically controlling said at least one laser device.

3. The laser sight of claim 2 further comprising a battery pack dimensioned to fit within said hand grips.

4. The laser sight of claim 3 wherein said connection means is a flexible circuit contained within said rifle.

5. The laser sight of claim 4 wherein said connection means is a cable external to said rifle.

6. A laser sight for a firearm having hand grips attachment members, said laser sight comprising:

a chassis mountable on said firearm, said chassis having a front face with at least one laser device housed within said chassis, with the light from said laser device exiting the front face of said chassis;

hand grips having interior and exterior surfaces, dimensioned and sized to be attached to the hand grips attachment members of said firearm, said hand grips having a plurality of waterproof rubber switches mounted on the exterior surfaces of said grips, said switches selecting said laser device;

connection means for electronically connecting said hand grips and said chassis.

7. The laser sight of claim 6 further comprising flexible circuit means, adjacent to and corresponding in size to the interior surfaces of said hand grips, for electronically controlling said laser device.

8. The laser sight of claim 7 further comprising a battery pack dimensioned to fit within said hand grips.

9. The laser sight of claim 7 wherein said connection means is a flexible circuit contained within said firearm.

10. The laser sight of claim 7 wherein said connection means is a cable internal to said firearm.

* * * * *